United States Patent [19]

Steele

[11] 3,983,915

[45] Oct. 5, 1976

[54] LOGGING STOP MEMBER

[76] Inventor: Earl E. Steele, 140 Hinsdale Road, Dalton, Mass. 01226

[22] Filed: July 29, 1975

[21] Appl. No.: 600,195

[52] U.S. Cl. ..... 145/1 R; 145/129; 254/104

[51] Int. Cl.[2] ..... B27G 19/08

[58] Field of Search ..... 145/1 R, 31 C, 35 R, 145/35 C, 129; 254/104

[56] References Cited

UNITED STATES PATENTS

| | | | |
|---|---|---|---|
| 799,891 | 9/1905 | Crane | 145/1 R |
| 1,057,101 | 3/1913 | Wachter | 145/50 R |
| 1,123,266 | 1/1915 | Farnham | 145/1 A |
| 1,619,695 | 3/1927 | Boese et al. | 145/129 |
| 2,542,368 | 2/1951 | Smith | 254/104 X |
| 2,814,219 | 11/1957 | Zern | 145/129 X |
| 3,598,496 | 8/1971 | Skinner | 145/129 |

*Primary Examiner*—Al Lawrence Smith
*Assistant Examiner*—J. T. Zatarga
*Attorney, Agent, or Firm*—Wenderoth, Lind & Ponack

[57] ABSTRACT

A stop member includes a flat member of uniform thickness and having attached at a position spaced from one end thereof an abutment member. The abutment member may be adjustable in the longitudinal direction of said flat member. The stop member is inserted into a cut made in a log by a chain saw until the abutment member abuts the exterior of the log.

2 Claims, 2 Drawing Figures

LOGGING STOP MEMBER

BACKGROUND OF THE INVENTION

The present invention is directed to an improved stop member for use by one employing a chain saw to cut logs and who desires to prevent the cut in the log from closing and thus binding on the chain saw.

Wedges have been employed for a great many years in the logging industry to prevent the cut in a log from closing due to the weight of the log and thus binding on the saw. Typical examples of such known logging wedges are shown in U.S. Pat. No. 3,515,372 to Courville and U.S. Pat. No. 1,198,436 to Gravel.

However, such logging wedges, typically called "bucking wedges", have a wedge-shaped configuration and normally must be driven into the cut in the log. This necessitates two people being involved in the logging operation, i.e. a person to operate a saw, and a person to drive in the wedge. If two persons are not available, it is necessary to interrupt the sawing operation to drive in the wedge. This is particularly disadvantageous when employing to restart the sawing operation with the saw chain of the chain saw within the cut in the log.

SUMMARY OF THE INVENTION

With the above discussion in mind, it is the principal object of the present invention to provide an improved stop member for insertion into the cut a log being sawed by a chain saw.

It is more particularly an object of the present invention to provide such a stop member which need not be driven into the cut in the log, but which will remain in the cut in the log without the necessity of being driven or manually wedged therein.

The above objects are achieved in accordance with the present invention by the provision of a stop member formed of a flat member of desirable material of a uniform thickness. The thickness of the flat piece is determined by the thickness of the cut to be made in the log, thus depending upon the particular chain saw and saw chain thereof.

A first end of the flat member is formed as a handle to facilitate grasping by an operator. At a distance from a second end of the flat member there is attached to the flat piece and extending transversally thereacross an abutment element.

Thus, when an operator is sawing through a log by means of a chain saw, and before the depth of the cut reaches the point where the weight of the log tends to close the cut, the stop member of the present invention may be inserted into the cut. Specifically, the end of the stop member opposite the handle is inserted into the cut in the log. The stop member will be inserted only a predetermined distance, at which point the abutment member will abut against the exterior of the log. Thus, the stop member need not be wedged in the cut in the log, but rather will maintain itself therein.

The tendency of the log to close the cut therein will cause the log to press tightly against the opposite sides of the flat member. However, due to the fact that the flat member is dimensioned dependent upon the dimensions of the chain saw employed, the stop member will completely prevent the log from binding on the chain saw.

In a modified embodiment of the invention, the attachment of the adjustment member to the flat member may be made adjustable, by means such as elongated slots in either of the flat member or the abutment member.

BRIEF DESCRIPTION OF THE DRAWINGS

Other objects and features of the present invention will become apparent from the following detailed description taken in conjuction with the accompanying drawings, wherein.

DETAILED DESCRIPTION OF THE INVENTION

Figure 1:
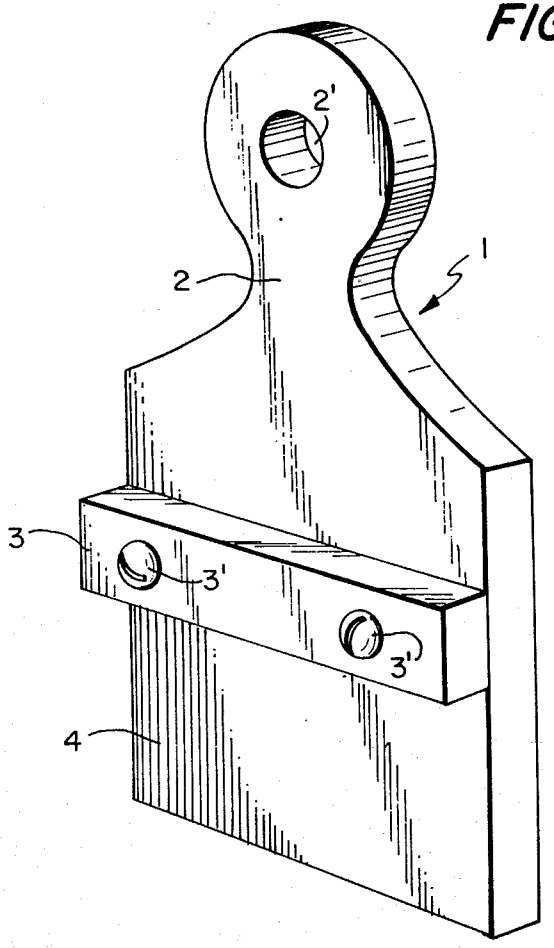
FIG. 1 is a perspective view of the stop member of the present invention.

With reference now to the drawings and in particular to FIG. 1 thereof, the stop member 1 of the present invention is basically formed of a flat member formed of a suitable material. Advantageously the material of the flat member should be a material having high strength properties and low weight. A particularly suitable material is aluminum.

At a first end thereof, the flat member has a handle 2 formed therein to facilitate usage by the operator. A hole 2′ may be formed in the handle 2 for attachment to the belt of the operator when the stop member 1 is not used.

Spaced a predetermined distance from the end of the flat member opposite the handle 2 is an abutment member 3. Abutment member 3 is attached to the flat member to extend transversally across one side thereof. Preferably, the length of abutment member 3 is equal to the transverse width of the flat member. Abutment member 3 may be fixedly attached to the flat member by any suitable means, such as screws 3′ illustrated in FIG. 1, or rivets.

Figure 2:
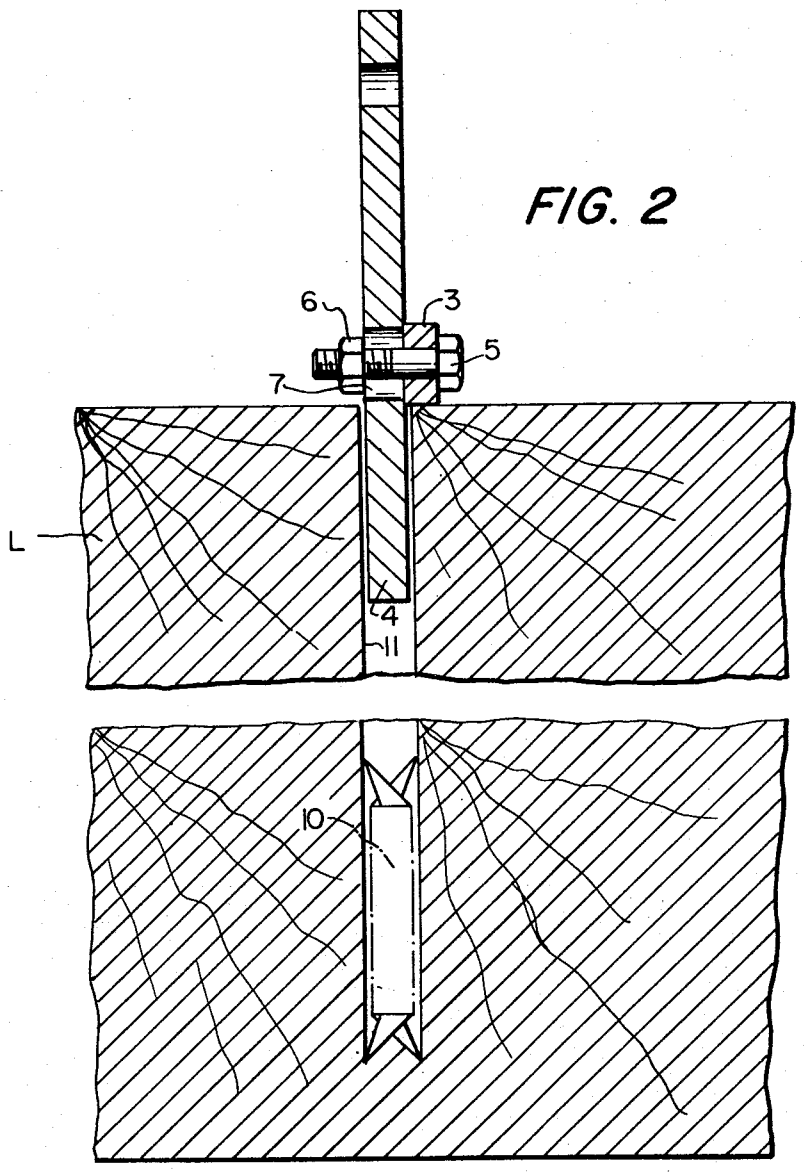
FIG. 2 is a longitudinal cross-sectional view through a portion of a log being cut by a chain saw and a cross-sectional view through the stop member of the present invention inserted within the cut in the log in the operative position.

Abutment member 3 may be attached to the flat member to be adjustable in the longitudinal direction thereof. This may be achieved by the provision of a series of openings in the flat member to receive the screws 3′. Alternatively, and as shown in FIG. 2, the flat member may be provided with elongated slots 7, and abutment member 3 may be attached by means of bolts 5 and nuts 6, such that abutment member 3 may be logitudinally adjusted with respect to the flat member. Further alternatively, the elongated slots could be formed in the abutment member itself.

Accordingly, the abutment member 3 defines an insertion section 4 of the stop member, insertion section 4 being inserted into a cut in a log.

With reference again to FIG. 2 of the drawings, there is shown a log L being cut by a chain saw schematically represented by reference numeral 10 such that a cut 11 is formed in the log. As is well known in the art, as the depth of cut 11 is made greater, the weight of the log tends to cause the cut 11 to be closed inwardly. If this tendency were permitted, the log would bind on the chain saw 10, thus preventing further cutting of the log.

In accordance with the present invention, as soon as the depth of cut 11 is such that the outermost portion of the chain saw 10 is of a sufficient depth within the log, the stop member 1 of the present invention may be employed to prevent binding of the chain saw. Specifically, insertion section 4 of the stop member 1 is inserted into the cut 11.

Continued sawing of the log will still result in a tendency of the log to close the cut 11. However, the log will abut against the sides of insertion piece 4 of stop member 1, and thus the cut 11 will not be closed and the log will not bind on chain saw 10.

The thickness of the flat member, and particularly of the insertion portion 4 thereof, is of uniform thickness. Therefore, the stop member 1 need not be wedged by hammering into the cut in the log. Further, the thickness of the flat member, and particularly insertion portion 4 thereof, is specifically determined in dependence upon the dimensions of the chain saw 10. That is, it is common knowledge that chain saws are of various sizes and will achieve various known sizes of cuts. The flat member of the stop member 1 is thus chosen to be equal to the thickness of the cut made by the particular chain saw to be employed. It will be apparent that by the above structural arrangements it will be impossible for the log to bind on the chain saw 10. It will further be apparent that this desired result is achieved without the need for wedging the stop member 1 into the cut 11. It will still further be apparent that the provision of abutment member 3 presents the stop member 1 from being inserted too far into the cut 11.

Thus, in accordance with the present invention the stop member 1 may be operatively employed solely by hand and without the need for hammering or wedging into the cut in the log.

In a specific example of the stop member of the present invention there was employed a flat member of aluminum three-eights of an inch thick, such thickness being predetermined by the particular chain saw employed. The member of aluminum was 7 inches long and 2½ inches wide. At one end of the member of aluminum there was formed a handle. One and one-half inches from the end of the flat member opposite the handle there was attached by two bolts and nuts an abutment member 2½ inches long extending completely across the width of the flat member. The abutment member was formed of aluminum and was one-quarter inch thick and extending in the longitudinal direction of the flat member by three-quarters of an inch.

It will be apparent that in a log sawing operation employing a plurality of chain saws capable of achieving a plurality of cut widths, it would be desirable to provide a plurality of stop members in accordance with the present invention, but wherein at least the insertion sections 4 thereof of are of different thicknesses.

It will be apparent that various modifications of the above specifically described structure may be made without departing from the spirit and scope of the present invention.

What is claimed is:

1. A stop member for insertion into a cut made in a log by a chain saw, said stop member comprising:

a flat member having first and second planar parallel major surfaces, said flat member being of uniform thickness throughout the length thereof;

a first end of said flat member being in the form of a handle;

an elongate abutment member of rectangular cross section extending transversely across said flat member at a position spaced from a second end thereof, said abutment member being spaced from said handle;

a plurality of means for adjustably attaching said abutment member to one of said major surfaces of said flat member, said plurality of attaching means maintaining said abutment member in said transverse position, said attaching means comprising means for adjusting the position of said abutment member in the longitudinal direction of said flat member between said ends;

said major surfaces of the portion of said flat member between said abutment member and said second end having a rectangular configuration; and said portion comprising means for insertion into a cut in a log, and said abutment member comprising means for abutting against the exterior of a log and limiting the extent of insertion of said insertion member into said cut.

2. A stop member as claimed in claim 1, wherein said attaching and adjusting means comprises longitudinal slots formed in one of said flat member and said abutment member, and nuts and bolts extending through said elongated slots and the other of said flat member and abutment member.

* * * * *